US005567188A

United States Patent [19]

Allebosch

[11] Patent Number: 5,567,188

[45] Date of Patent: Oct. 22, 1996

[54] JET POWERED WATER VEHICLE

[76] Inventor: Christian Allebosch, Ruelle de l'Onot, 4, B-5170 Profondeville, Belgium

[21] Appl. No.: 495,078

[22] Filed: Jun. 27, 1995

[51] Int. Cl.[6] ..... B63H 11/00

[52] U.S. Cl. ..... 440/38; 114/61; 114/283; 114/292

[58] Field of Search ..... 114/61, 123, 272, 114/273, 274, 282, 283, 292; 440/38

[56] References Cited

U.S. PATENT DOCUMENTS

| | | | |
|---|---|---|---|
| 2,821,948 | 2/1958 | Harkson | 114/272 |
| 3,145,687 | 8/1964 | Conley | 440/38 |
| 4,141,309 | 2/1979 | Halboth . | |
| 4,348,977 | 9/1982 | Okajima | 114/273 |
| 4,459,117 | 7/1984 | Jordan | 440/38 |
| 4,836,298 | 6/1989 | Laboureau | 114/61 |

*Primary Examiner*—Stephen Avila

*Attorney, Agent, or Firm*—Sughrue, Mion, Zinn, Macpeak & Seas

[57] ABSTRACT

The invention relates to a hydro-jet powered water vehicle having a jet motor and a seat for a passenger, the seat being provided with means for the feet of the passenger. The vehicle is designed so that, when it does not carry any load, the floating center of the vehicle is located between the seat and one end of the vehicle and so that an open channel extends between the front end and the back end of the vehicle.

9 Claims, 7 Drawing Sheets

JET POWERED WATER VEHICLE

THE PRIOR ART

Many different kinds of motor powered vehicles are known, such as boats, watercrafts with a motorcycle-like configuration or Jet-ski®, . . .

Personal Motor Boats have generally one hull and have a floating center located between the front end of the boat and the passenger seat or seats. Such personal motor boats have never been provided with floating means defining an open channel extending between the front and back ends and having a vertical symmetrical plane.

Jet-ski or watercrafts with a motorcycle-like configuration which are sold now-a-days by Bombardier or Kawasaki have only one hull in which no open channel are defined between the front and back ends. Furthermore, in these watercrafts, the people using it are standing or sitting on top of the motor for driving into rotation the turbine or between the said motor and the back end of the watercraft. The floating center of these watercrafts is adjacent to the front end thereof. The stability of these watercrafts is poor.

An attempt for a watercraft with a motor-cycle-like configuration having two parallel hulls is disclosed in U.S. Pat. No. 4,141,309. This watercraft which is provided with a propeller, whether or not in motion, is unstable. In this watercraft, the motor is located between the front end and the seat, while for the watercraft in motion or not, the channel defined between the two hulls is completely immerged.

The invention relates to a new kind of jet powered water vehicle allowing to reach very high speed, while having an increased stability at low speed, as well as at high speed.

BRIEF DESCRIPTION OF THE INVENTION

The water vehicle of the invention is adapted for carrying a load which is lower than a maximum predetermined load. Said vehicle comprises:

(a) floating means extending between a front end and a back end, said means being agenced so as to define an open channel between said front end and back end, said channel having a vertical symmetrical plane extending between said front and back ends;

(b) a jet motor with a water nozzle, said motor being attached (for example by means of crossbeams) to the floating means in the vicinity of one end of the floating means;

(c) at least one seat for a passenger, said seat being attached (for example with crossbeams) to the floating means and being provided with means on which rest the feet of the passenger, and (d) means for controlling the motion of the vehicle.

Preferably, the bottom of the seat is about at the same level than the engine or motor mounting plane providing a lower center of gravity and thus a better stability.

The water vehicle of the invention when it does not carry a load has a floating line and a floating center, such that the seat is located between, on the one hand, the vertical plane perpendicular to the symmetrical plane and containing the floating center and, on the other hand, the vertical plane perpendicular to the symmetrical plane and situated at the end of the floating means opposite to the end, in the vicinity of which the motor is attached. At most 50% of the vertical open surface of the channel extending in a vertical plane perpendicular to the symmetrical plane, and extending through the floating center is located under the floating line.

Preferably the motor is attached in the vicinity of the back end.

In this case, the seat is attached to the floating means and is provided with means on which rest the feet of the passenger, said means and seat being agenced so that the seat is located between the front end and the motor and so that the means for the feet is located between the seat and the front end.

The water vehicle when unloaded has then a floating center located between the seat and the back end, at most 50% of the vertical open surface of the channel extending in a plane perpendicular to the symmetrical plane and perpendicular to the floating line, and extending through the floating center being located under the floating line.

Preferably, the water vehicle of the invention, when it carries the maximum predetermined load has such floating means that the vertical open surface of the channel extending perpendicular to the symmetrical plane and passing through the floating center is at least 5%, preferably 10% not immerged, i.e. above the floating line (open surface perpendicular to the floating line or plane).

The floating means advantageously exert such a floating force that when the vehicle carries the maximum load, the water nozzle is substantially below the water level or floating line at a low forward speed, for example a speed lower to a first predetermined speed such as the minimum planing speed required so as to lift the vehicle provided with a minimum load above or substantially above the water. The floating means are also advantageously provided with planing means, so that at a speed higher than a second determined speed greater than the first determined speed, the floating means substantially plane above or on the water surface, while the water nozzle is above the water level. Said second determined speed is for example the minimum planing speed required so as to lift the vehicle with the maximum load above the water surface.

The invention relates also to a water vehicle, the jet motor of which is provided with a means for acting on the water flow flowing through the nozzle so as to have a motion of the vehicle in a direction opposite to the direction of the water flow in the nozzle.

Further details and characteristics of a preferred embodiment will be disclosed in the following description, in which reference will be made to the attached drawings.

DESCRIPTION OF A PREFERRED EMBODIMENT

Figure 1:
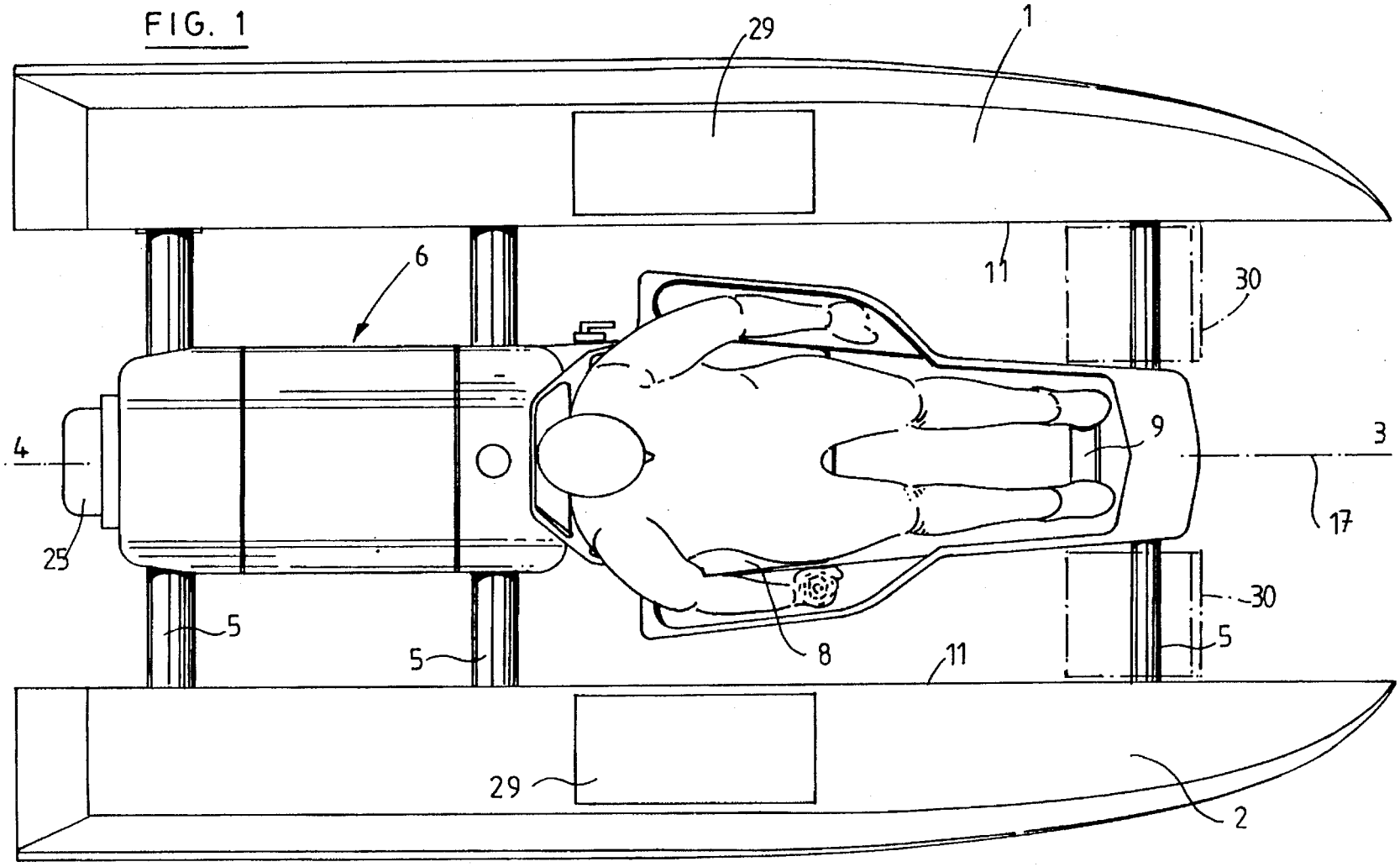
FIG. 1 is an upper view of a device according to the invention, when carrying a passenger but at a speed lower than the minimum planing speed.

The water vehicle shown in FIG. 1 comprises the following elements:

two hulls 1,2 extending between a front end 3 and a back end 4 and linked together by crossbeams 5;

a jet motor 6 with a water nozzle 7, said motor being attached to a crossbeam 5 adjacent to the back end 4, a seat 8 for a passenger, said seat being linked to a crossbeam 5 and being provided with a plate 9 on which rest the feet of the passenger, said plate 9 being oriented with respect to the seat 8 so that the legs of the passenger extend substantially in a plane P, and means 10 for controlling the motion (speed, direction, . . . ) of the vehicle, said means comprising a stick 10A.

The hulls 1,2 have each a vertical face 11 extending between a front line 12, a back line 13, a lower line 14 and an upper line 15. Said two hulls 1,2 are separated the one from the other, so as to define between their vertical faces 11 an open channel 16 having a central vertical symmetrical plane 17.

The seat 8 is designed so as to be located between the front end 3 and the motor 6, while the plate 9 between is the front end 3 and the seat 8.

Figure 6:
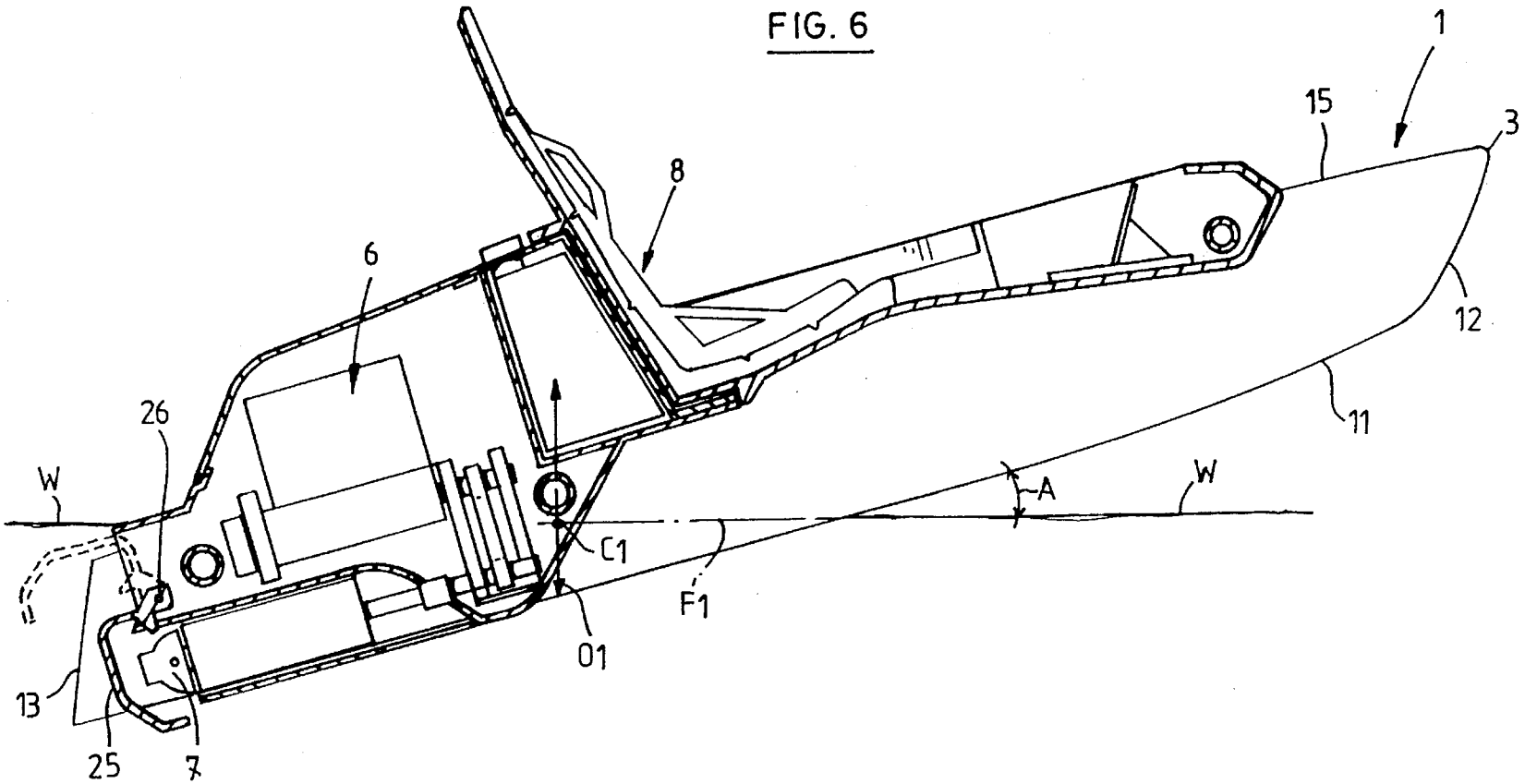
FIG. 6 is a view similar to FIG. 3, but for the device not carrying the passenger.

The water vehicle, when it does not carry a load, has a floating center located between the seat and the back end 4 (see FIG. 6). Said floating center C1 is located in the vertical symmetrical plane 17, just below the motor or adjacent to the motor. The hulls 1,2 of the water vehicle, when it does not carry a load, have a front end 12 which is less immerged than the back end 13. Said front end 12 is even preferably not immerged in the water and is located above the water level. With respect to the floating line F1, the lower lines 14 of the faces 11 of the hulls 1,2 are inclined, the angle of inclination A being of about 10°–15° or even more. The lower line 14 has a part which is substantially linear, the end of said linear part adjacent to the back line 13 being under the floating line F1, while the opposite end of the linear part adjacent to the front line 12 is above the floating line F1.

The channel 16 which is defined between the two vertical faces 11 of the vehicle without load has a vertical open surface O1 extending in a plane perpendicular to the vertical symmetrical plane 17, as well as to the floating line F1, and passing through the floating center C1 which is at most 50% immerged, for example 25% (75% of the part of the hulls 1,2 located in the plane in which extends the open surface O1 is above the water level).

Figure 2:
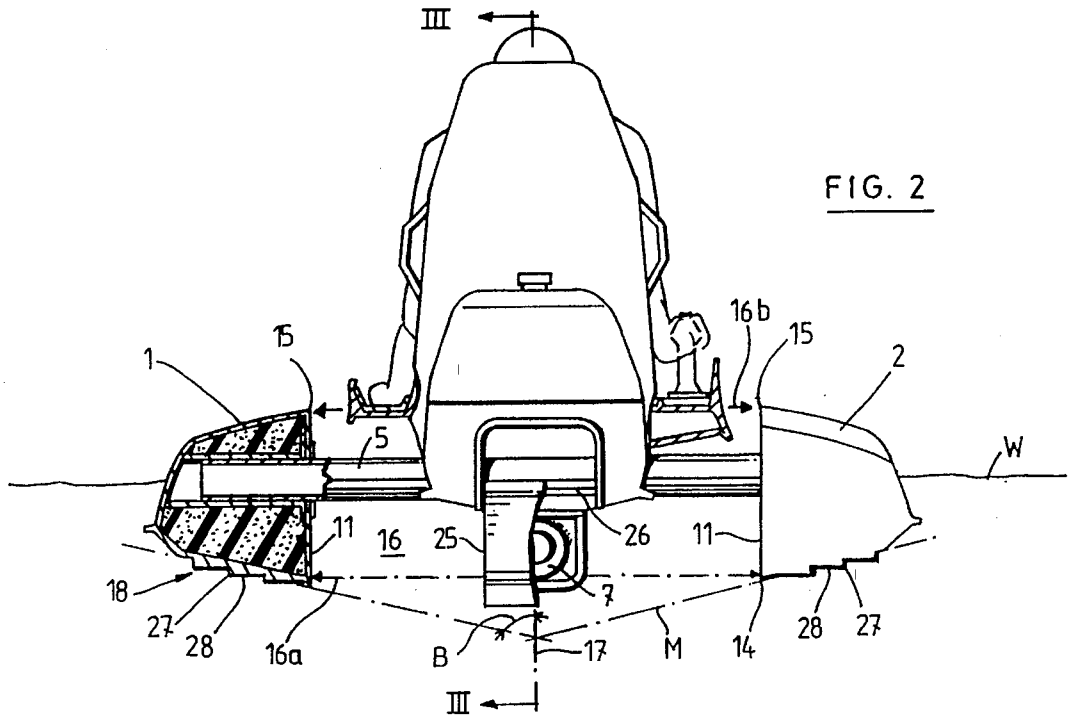
FIG. 2 is a back view of the device of FIG. 1, partly in cross-section.
Figure 4:
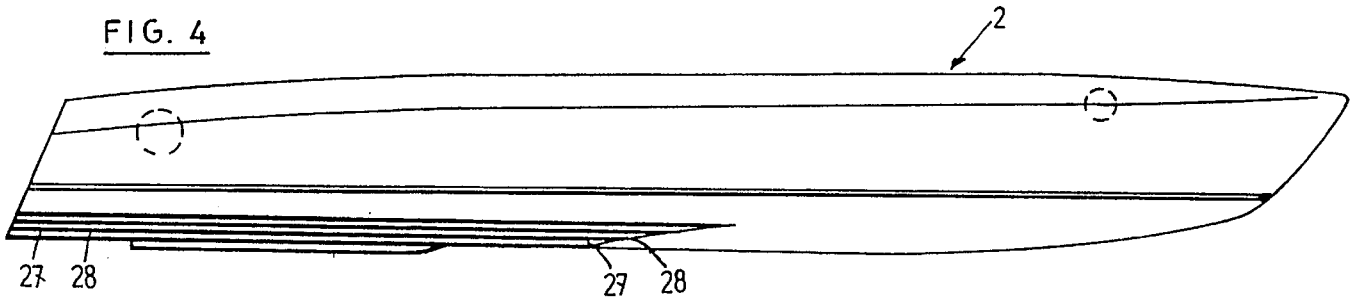
FIG. 4 is a side view of a floating means of the device of FIG. 1.
Figure 3:
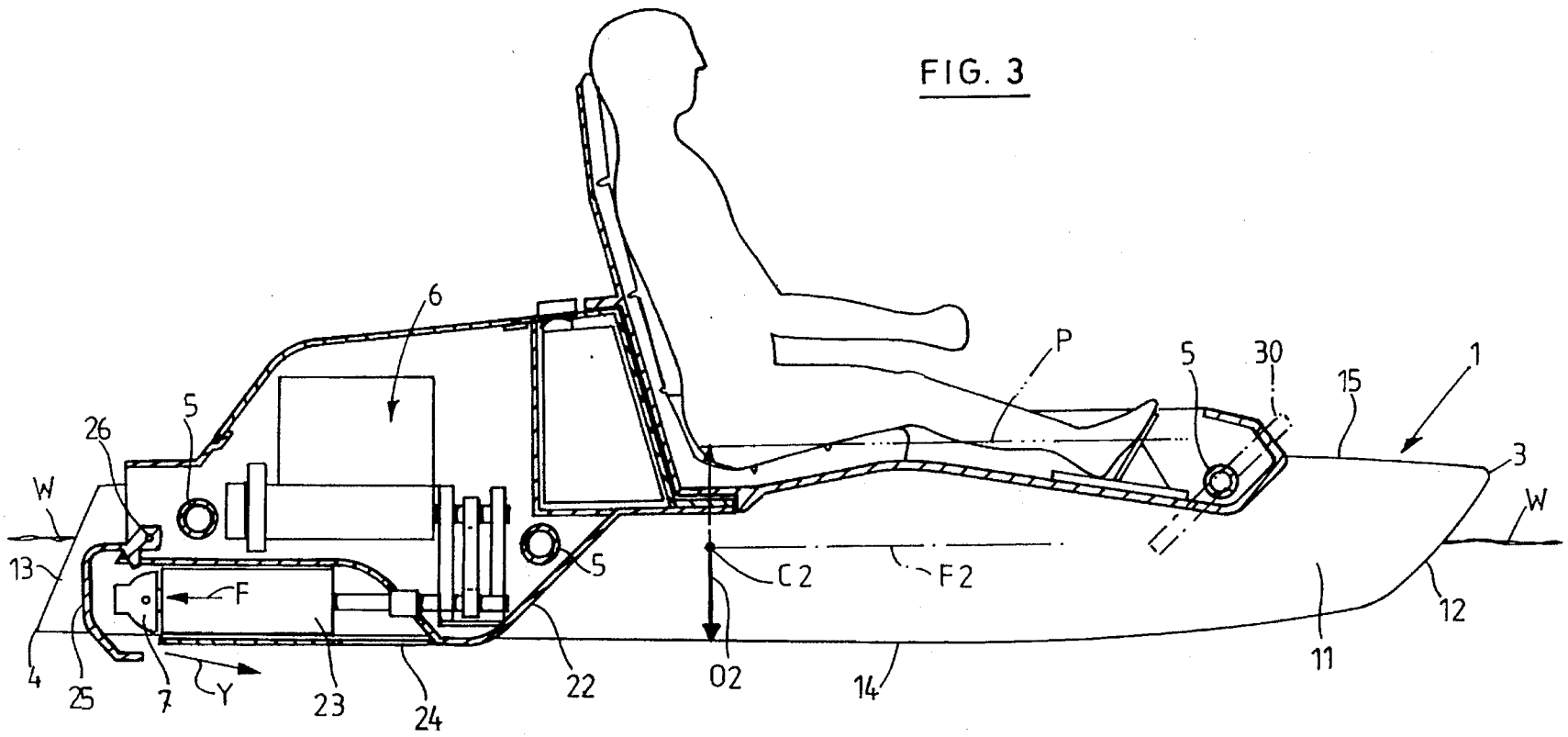
FIG. 3 is a cross-section view along the line III—III of FIG. 2.

The channel 16 (see FIGS. 2 and 3) is open at its front end 3, at its back end 4, at its face 16*a* turned towards the bottom of the water surface (underneath face) and at its face 16*b* turned towards the sky (upper face). Said channel 16 has thus a front opening extending between the front lines 12 of the faces 11, a back opening extending between the back lines 13 of the faces 11, a bottom (underneath) opening 16*a* extending between the lower lines 14 of the faces and an upper opening 16*b* extending between the upper lines 15 of the faces. The open end of the nozzle 7 is preferably located within the channel 16, for example at a distance d of 5–15 (for example 10) cm from the back opening of the channel 16.

When the water vehicle carries the passenger (load), the floating center C2 is located between the floating center C1 of the vehicle without load and the front end 3. When the vehicle is not moving on a water surface, the linear part of the lower line 14 of the hulls 1,2 is under the water line F2.

At least about 10% (for example 15%) of the vertical open surface of the channel 16 extending in a plane perpendicular to the vertical symmetrical plane 17, as well as to the floating line F2, is not immerged from the front end 3 to the back end 4.

Figure 5:
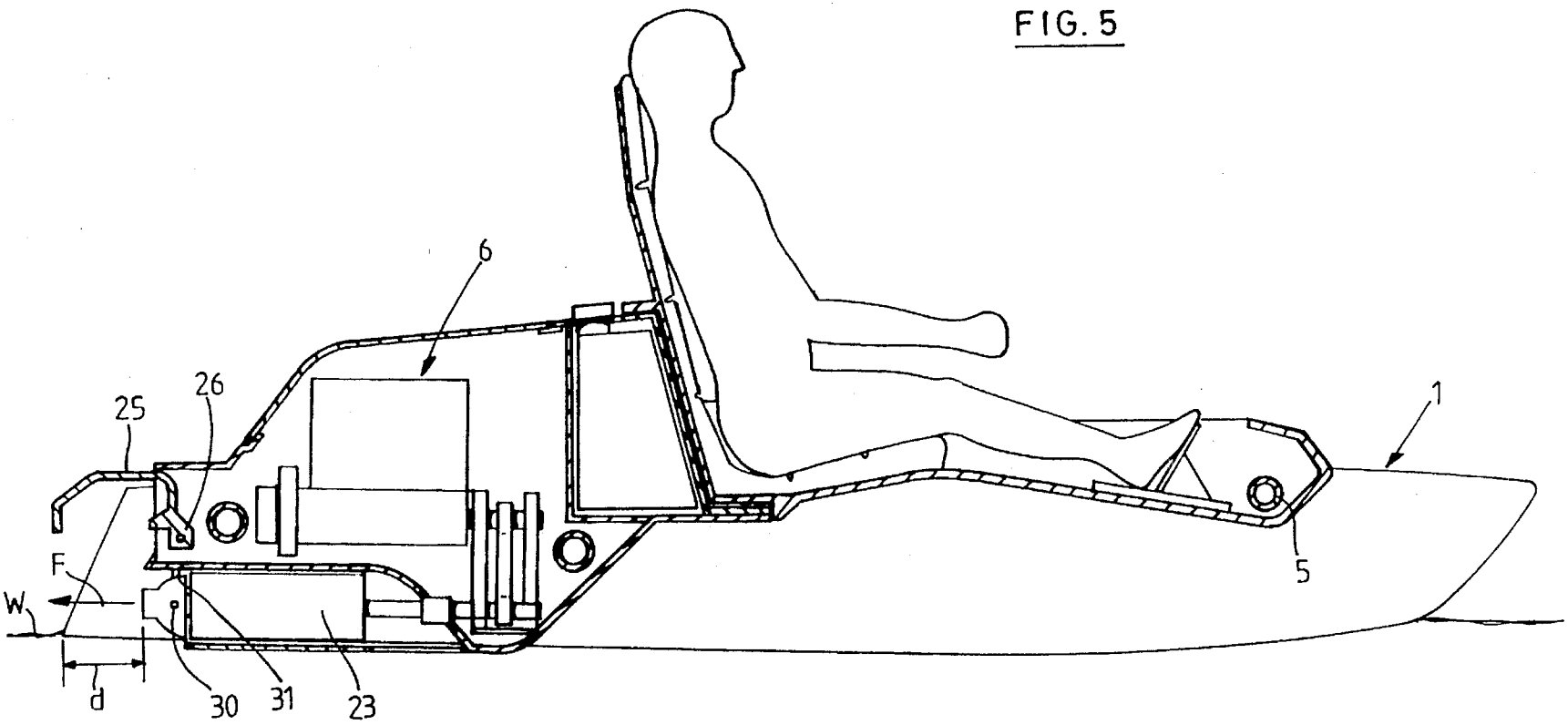
FIG. 5 is a view similar to FIG. 3, but showing the position of the device at a speed higher than the minimum planing speed.

The hulls 1,2 are provided with planing means 18 so that when the water vehicle reaches a speed higher than a predetermined speed (minimum planing speed), the hulls 1,2 substantially plane above the water level. In this position, shown in FIG. 5, the water nozzle 7 is above the water level W. When said minimum planing speed is not reached, the open end of the nozzle 7 is under the water level or at least partly under the water level. The floating force exerted by the hulls is such that the open end of the nozzle is under the water level when the vehicle carries the maximum authorized load, while not moving, as well as when the vehicle does not carry any load (see FIG. 6). For the water vehicle carrying the maximum authorized load, while not moving, more than 30% of the volume of the floating means is immerged, for example about 50–75% of the floating means are immerged.

The jet motor 6 is attached to a crossbeam 5 by means of a shaped plate 22 for cutting the water. The motor 6 comprises a turbine 23 for sucking water through an opening 24 and for expelling said water in the nozzle 7. The opening 24 extends below the underneath opening 16*a* of the channel defined between the two lower lines 14 of the faces 11. Said opening 24 extends advantageously just below said underneath opening 16*a* or in such a way that when the minimum planing speed is reached, the opening 24 still contacts the water and is below the water level.

The jet motor 8 is provided with a means 25 which can be actuated between a first position (position shown in FIG. 5) in which the means does not act on the water flow expelled through the nozzle 7 and a second position (position shown in FIG. 3) in which the means acts on the water flow expelled through the nozzle 7, so as to reverse said flow. When said means 25 acts on the water flow F, the water flow F contacts the means 25 and is conducted to flow in a direction Y opposite to the direction of the water flow F in the nozzle 7. Said means is a flap with a curved face, said flap being mounted on a shaft 26 and being actuated by a control means for pivoting the flap between the said first and second positions.

The planing means are located in the vicinity of the back end 13 of the hulls. Advantageously, said means are located between the vertical plane (O2) perpendicular to the median plane 17 and passing through the floating center C2 of the vehicle carrying the maximum authorized load, while not moving, and the back end 13. This planing means consist for example of planar parts 28 present on the underneath face 28 of the hulls 1,2. The said planar parts 28 of one hull substantially define a plane M forming an angle B of 70°–85° with the median plane 17. The plane M of the underneath face 28 of the hull 1 intersects the plane M of the underneath face 28 of the hull 2 along a line extending into the median plane 17.

Said underneath faces are provided with spraylines 27 so as to increase the stability (directional stability) of the water vehicle.

The hulls are provided with a cavity suitable to receive personal equipment, food, beverage, . . . , said cavity being closed by means of a cover 29.

Advantageously, the water vehicle can be provided with an aileron 30 near the front end 3 and extending partly in the channel 16 (shown in broken lines).

So as to facilitate the planing of the water vehicle, the part of the hulls 1,2 adjacent to the front end 12 is shaped so as cut the water and so as to lift the hulls.

The nozzle 7 is mounted on a system provided with two shafts 30,31 whereby the direction of the flow F expelled out of the nozzle 7 can be modified.

Preferably, the bottom of the seat is about at the same level as the motor, when the vehicle carries the passenger.

The floating means 1,2 are advantageouly the only floating means of the device. Preferably, the device is not provided with supplementary floating elements, elements not acting as the major floating elements, i.e. elements representing less than 50%, preferably less than 25% of the global floating force or volume.

Advantageously, the major floating elements (i.e. the elements suitable for ensuring the floating of the major load, for example more than 75% or even more than 85% of the load) are two floating elements located at or near the lateral side of the device.

Figure 7:
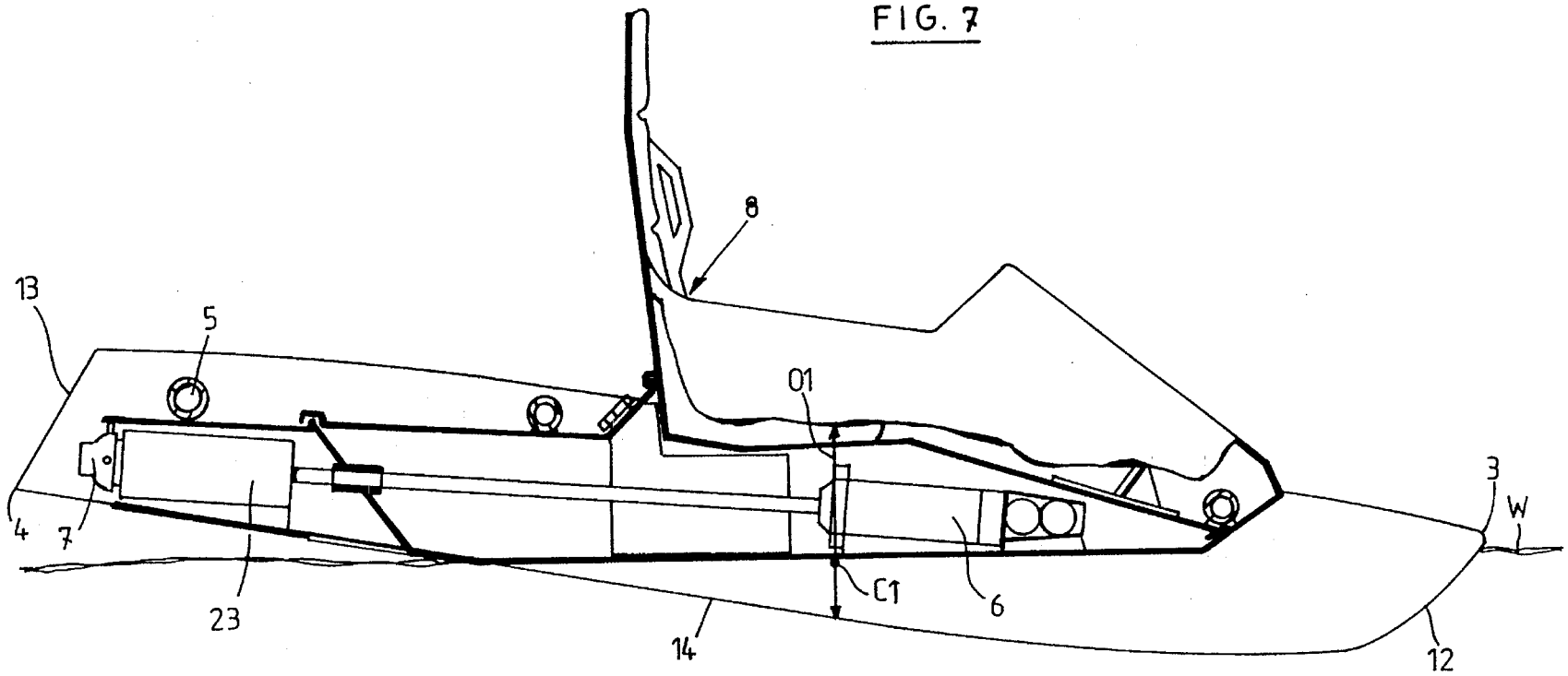
FIG. 7 is a view similar to that of FIG. 6 but of another device according to the invention.
Figure 8:
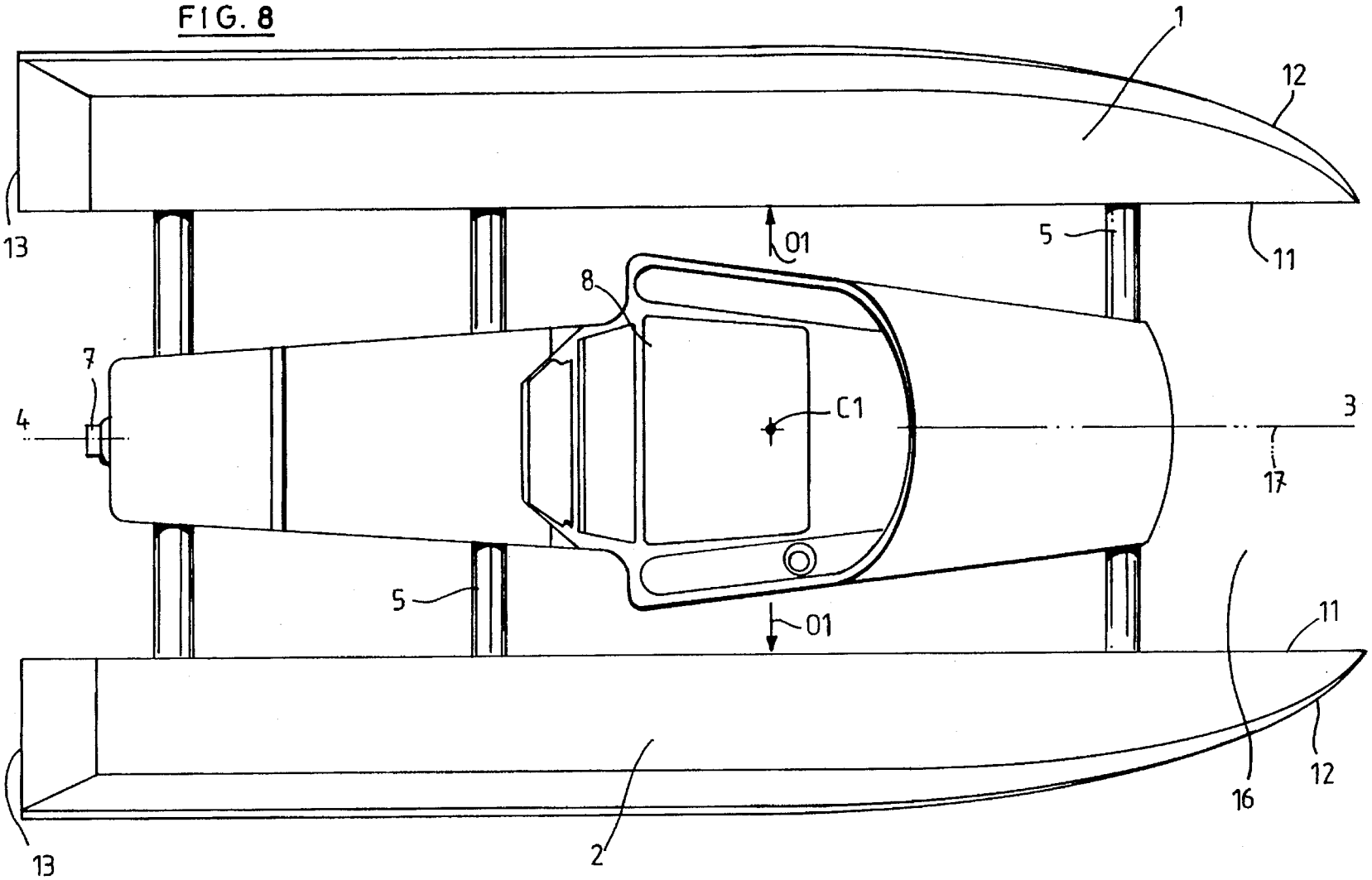
FIG. 8 is an upper view of the device of FIG. 7.

In an embodiment shown shematically in FIG. 7, the motor 6 is located in the vicinity of the front end 3 of the vehicle. The water vehicle, when unloaded has hulls 1,2, the front ends 12 of which are under the water level, while the back ends 13 of which are above the water level W. The seat 8 is located between the back end 4 and the vertical plane perpendicular to the symmetrical plane 17 of the channel 16 and containing the floating center C1.

When the vehicle (not moving) carries the passenger having a minimum load, the back end 13 of the hulls 1 contacts the water level, whereby the linear part of lower line 14 of the hulls is substantially parallel to the water level W.

The channel has an open surface (vertical) O1 which is at least 5%, preferably at least 10%, above the water level.

When carrying the passenger, the channel has an open surface which is at least 5, preferably 10% above the water level (floating line).

What I claim is:

1. A hydro-jet powered water vehicle comprising two hulls provided with planing means so that, when a minimum forward speed is reached, the hulls substantially plane on the water surface, said vehicle being adapted for carrying at least one passenger with a load lower to a maximum authorized load, said vehicle when unloaded having an unloaded floating line and comprising:

(a) two hulls having each a vertical face extending between a front end, a back end and a lower end line, said hulls being agenced so that the vertical faces are parallel together and so as to define between the vertical parallel faces an open channel having a front open end, a back open end and a vertical symmetrical plane, the lower end lines of the hulls defining there between a surface which is substantially horizontal when the minimum planing forward speed is reached and being inclined with respect to the horizontal when the vehicle is unloaded, the inclination of said lower end lines with respect to the horizontal being such that the part of said lower end lines adjacent to the front end is less immerged than the part of the said lower end lines adjacent to the back end, said hulls having each an underneath face comprising planar parts which substantially define all together a plane forming an angle of 70°–85° with the vertical symmetrical plane of the open channel, said planar parts acting as planing means;

(b) a jet motor with a motor, a turbine driven by said motor and a water nozzle, said motor being attached to the hulls, in the vicinity of their back end and so as to be located between the two vertical parallel faces of the hulls, said turbine sucking water through an opening extending below the surface defined between the lower end lines of the hulls and expelling water in the nozzle, said nozzle being located between the said two vertical parallel faces of the hulls defining the open channel, the water nozzle being at least substantially under the water level for a forward speed of the vehicle lower to the minimum forward speed required for the planing of the vehicle, while, for a forward speed of the vehicle higher than the minimum forward speed required for than planing of the vehicle, the water nozzle is above the water level;

(c) at least one seat for a passenger, said seat being attached to the hulls and so as to be located between the two vertical parallel faces of the hulls, said seat being provided with means on which rest the feet of the passenger;

(d) means for controlling the motion of the vehicle, and (e) a shaped plate comprising two parts which are located between the opening of the turbine and the front open end of the channel, a first part being inclined with respect to the surface defined between the lower end lines of the hulls and having a lower end line perpendicular to the symmetrical plane of the channel and situated just below the surface defined between the lower end lines of the hulls, while the second part located between the opening of the turbine and the lower end line of the first part is parallel to the surface defined between the lower end lines of the hulls;

said water vehicle, when unloaded having such a floating center that the seat is located between, on the one hand, the vertical plane perpendicular to the symmetrical plane and passing through the floating center and, on the other hand, the front open end of the channel, while the channel is—such that for the unloaded water vehicle, at most 50% of the vertical open surface of the channel extending in a vertical plane perpendicular to the symmetrical plane, and passing through the floating center is located under the unloaded floating line, and—such that, for the vehicle carrying the maximum authorized load, the channel has a passage above the floating line from the front open end of the channel up to the back open end of the channel, for each open vertical surface of the channel perpendicular to the symmetrical plane thereof, the minimum vertical surface of the said passage being at least 10% of the considered open vertical surface of the channel.

2. The water vehicle of claim 1, in which the seat is located between the front open end of the channel and the motor, and in which the means for the feet is located between the seat and the front open end of the channel, the water vehicle when unloaded having a floating center located between the seat and the back open end of the channel.

3. The water vehicle of claim 2 in which, when it carries the maximum authorized load and when the motor is not actuated, the water nozzle of the motor is below the floating line and at least 30% of the volume of the hulls are below the floating line, the channel being defined between two vertical parallel faces, extending each between a front line, a back line, a lower end line and an upper line, so as to form a front opening of the channel extending between the front lines, a back opening of the channel extending between the back lines, an underneath opening of the channel extending between the lower end lines and an upper opening of the channel extending between the upper lines.

4. The water vehicle of claim 2, in which the nozzle of the motor is located within the channel in the vicinity of its back open end.

5. The water vehicle of claim 1, in which the nozzle of the motor is located at a distance comprised between 5 and 15 cm from the back open end of the channel.

6. The water vehicle of the claim 2, in which the jet motor is provided with a means for acting on the water flow flowing through the nozzle of a turbine so as to have a motion of the vehicle in the direction opposite to the direction of the water flow in the nozzle.

7. The water vehicle of claim 6, in which the means for acting on the waterflow is a flap with a curved face, said flap being connected to a control means so as to move it between a position in which the flap does not modify the direction of the water flow flowing through the nozzle of the turbine and a position in which the flap directs the flow flowing out of the nozzle under the nozzle.

8. The water vehicle of claim 1, in which the inclination of the lower end lines of the hulls with respect to the horizontal for the unloaded vehicle is comprised between 10°–15°.

9. The water vehicle of claim 1, in which the seat has a bottom which is substantially at the level of the motor driving the the turbine.

* * * * *